US008661760B2

(12) United States Patent
Williams et al.

(10) Patent No.: US 8,661,760 B2
(45) Date of Patent: Mar. 4, 2014

(54) WIND RESISTANT TILE ROOFING SYSTEM

(71) Applicants: John M. Williams, Wells, VT (US); Albert L. Galloup, Granville, NY (US)

(72) Inventors: John M. Williams, Wells, VT (US); Albert L. Galloup, Granville, NY (US)

( * ) Notice: Subject to any disclaimer, the term of this patent is extended or adjusted under 35 U.S.C. 154(b) by 0 days.

(21) Appl. No.: 13/742,187

(22) Filed: Jan. 15, 2013

(65) Prior Publication Data

US 2013/0180201 A1 Jul. 18, 2013

Related U.S. Application Data

(60) Provisional application No. 61/587,597, filed on Jan. 17, 2012.

(51) Int. Cl.
*E04D 1/34* (2006.01)

(52) U.S. Cl.
USPC ..... 52/547; 52/551; 52/712

(58) Field of Classification Search
USPC ..... 52/547, 551, 478, 498.1, 489.1, 712
See application file for complete search history.

(56) References Cited

U.S. PATENT DOCUMENTS 476,381 A * 6/1892 Hawthorne ..... 52/276
676,579 A * 6/1901 Esselen ..... 52/26
718,165 A * 1/1903 Sneden ..... 52/548
757,285 A * 4/1904 Duchemin ..... 52/547
1,270,905 A * 7/1918 White ..... 52/547
1,574,098 A * 2/1926 Kridler ..... 52/547
1,790,860 A * 2/1931 Harvey ..... 52/548
1,814,405 A * 7/1931 Myhre ..... 52/547
2,106,946 A * 2/1938 Frederickson ..... 74/650
2,149,818 A * 3/1939 North ..... 52/409
2,588,673 A * 3/1952 Tyson ..... 52/546
4,422,278 A * 12/1983 Fujihiro et al. ..... 52/714
4,426,823 A * 1/1984 Kobe ..... 52/748.1
5,794,396 A * 8/1998 Gibbs ..... 52/518
6,125,592 A * 10/2000 Hickey et al. ..... 52/543
6,739,105 B2 * 5/2004 Fleming ..... 52/513
7,444,790 B2 * 11/2008 Hick ..... 52/547
7,448,177 B2 * 11/2008 McClintick ..... 52/551
7,454,873 B2 * 11/2008 McClintick ..... 52/551
8,033,072 B2 * 10/2011 McClintick ..... 52/551
8,215,070 B2 * 7/2012 Railkar et al. ..... 52/173.3
2007/0151171 A1 * 7/2007 McClintick ..... 52/87
2012/0055111 A1 * 3/2012 Fernandez Fernandez ..... 52/543

* cited by examiner

*Primary Examiner* — Robert Canfield
(74) *Attorney, Agent, or Firm* — Lawrence J. Shurupoff

(57) ABSTRACT

An integral strip and fastener installation system is provided for light weight slate and tile roofing systems installed with a single overlap between each row or course of tile. A specialized fastener hook is formed with one or more lateral projections or wings installed underneath one or more slate tiles to anchor the fastener to the roof at least in part by the weight of the overlying tiles. This anchoring supports and reinforces the open mouth of the hook against deflection from high winds and thereby enables the hook to hold a tile securely under high wind loads.

18 Claims, 5 Drawing Sheets

WIND RESISTANT TILE ROOFING SYSTEM

CROSS REFERENCE TO RELATED APPLICATION

This application claims the benefit and priority of U.S. provisional patent application Ser. No. 61/587,597 filed Jan. 17, 2012, entitled Wind Resistant Tile Roofing System and which is incorporated herein in its entirety.

BACKGROUND

Conventional slate tile roofs are highly resistant to high winds due to the typical overlapping of three layers of slate along each row or course of slate. That is, the weight of two additional tiles bears down on a lower or bottom tile to press downwardly and hold the bottom tile in place during high winds. Moreover, conventional fasteners, such as nails, provide a strong wind resistant mounting of the slate tiles to the underlying roof.

Newer slate tile roofing systems eliminate the "three layer" conventional system noted above. These systems overlap a lower or bottom tile with a small portion of a single upper tile. While these systems are economical, as they use less tile per unit area of roof and reduce the weight of the tile bearing on an underlying roof, they do not perform well in high winds. That is, because less weight is applied to each row of tiles, it is easier for the wind to flow beneath a tile and lift it off the roof.

This wind problem has proven particularly acute when roofing tiles are secured with conventional "hook and strip" type fasteners. These fasteners provide an elongated strip having a series of hooks secured along the strip at regular spacings. Once a strip is properly nailed or otherwise fixed to a roof, an installer can quickly and easily insert roofing tiles into the open mouth of the hooks so as to hold the tiles in place on the roof. No nails are driven through the roofing tiles so that only wire hooks hold the tiles in place.

When wind flows under a tile held by one or more hooks on a hook and strip mounting, the resilient wire which forms the hooks bends upwardly so that the mouth on the hook opens up with the free end of the hook taking a permanently open set, thereby releasing a tile from the hook. The result is a lost tile, blown away by the wind.

SUMMARY

A hook and strip roofing tile installation system is disclosed which is designed to accommodate modern "light weight" slate tile roofing constructions where only a single small overlap exists between each course or row of tiles. The hook and strip installation system is designed to hold slate and ceramic roofing tiles securely in place under high winds, such as up to 110 miles per hour.

Each hook is provided with an anchor portion which is installed below a pair of tiles on an adjacent lower course or row of tiles. The anchor portion includes a pair of integral laterally-extending wings or projections located adjacent each hook. The wings secure the free or bottom end of the fastener and the hook closely to the underlying roof. With a short shank of the hook pressed against a weatherproofing sheet underlying the tile, and the wings pressed against the weatherproofing sheet by the weight of two adjacent tiles, the hook and free end of the fastener from which the hook extends are securely held in place.

By holding down the free or bottom end of the fastener, a very short hook portion is exposed to bending forces from the wind. This is contrasted with a relatively long cantilevered shank and hook on conventional hook and strip fasteners which are subject to large bending moments from high winds. Once the free end portion and the hook portion of these conventional fasteners begin to bend upwardly as the tiles pivot and lift the fasteners upwardly about their attachment points on a mounting strip, the fasteners quickly lift up from the roof, the mouths of the hooks bend and open up, take a permanent set and release a tile into the wind. This is avoided by the high strength slate tile fastening system described below.

DETAILED DESCRIPTION OF REPRESENTATIVE EMBODIMENTS

Figure 1:
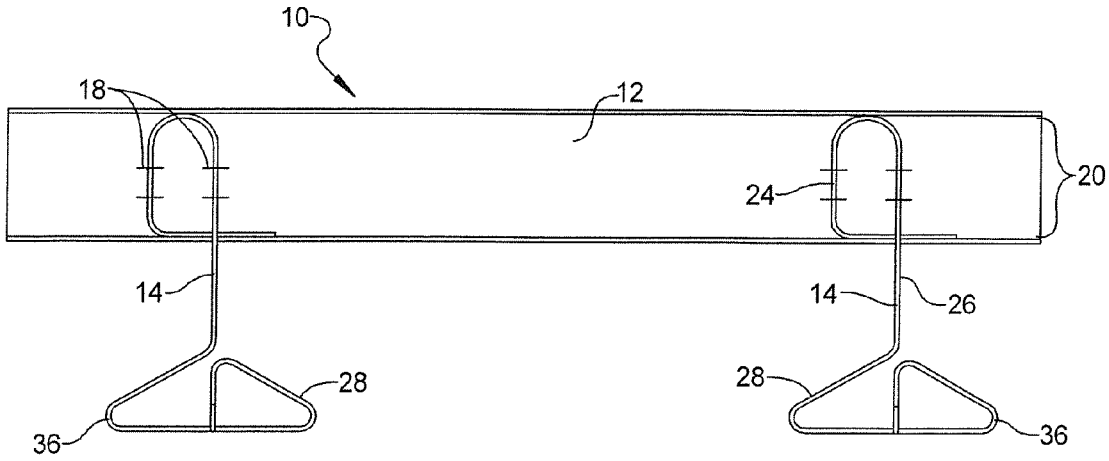
FIG. 1 is a top plan view of a hook and strip fastening system in accordance with a representative embodiment of this disclosure.

As seen in FIG. 1, a hook and strip fastening assembly 10 includes a base strip 12 and a plurality of fasteners 14 mounted along the base strip 12. The fasteners 14 can be mounted at fixed or variable spacings along the base strip 12 with any suitable fastener such as staples 18. Adhesives can also be used to bond the fasteners 14 to the base strip 12.

Figure 2:
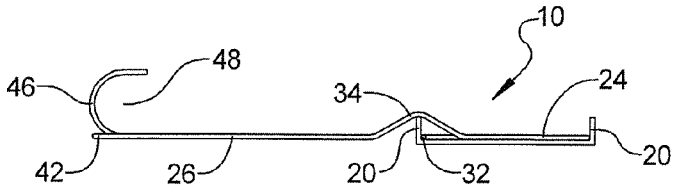
FIG. 2 is a side view of a fastener of FIG. 1.

The base strip 12 can be formed of flexible plastic, sheet metal or even flexible fabric. As seen in FIG. 2, the base strip 12 can be formed with one or more upstanding ribs 20 which provide a guideway for receiving and holding one or more fasteners in position on the base strip. That is, the ribs 20 provide abutment surfaces which engage and hold the fasteners in place in addition to the staples 18 or adhesives.

Figure 3:
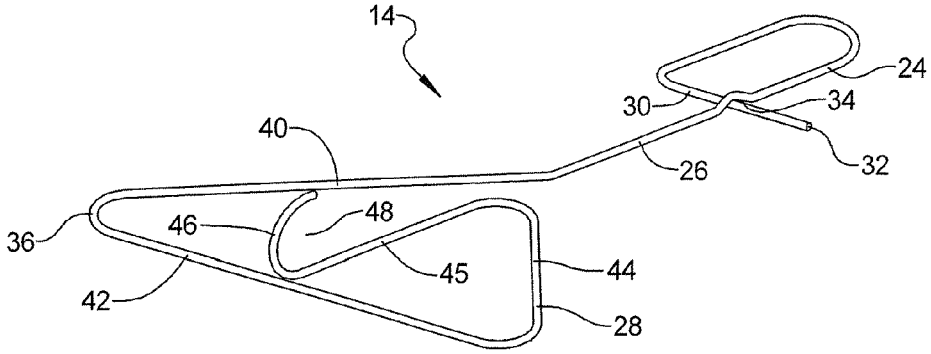
FIG. 3 is a perspective view of the fastener of FIG. 2.

As seen in FIGS. 1, 2 and 3, each fastener 14 is formed with a looped mounting portion 24, a straight mid portion or shank portion 26, and a flared lower anchor portion 28. Fasteners 14 can be formed of wire such as stainless steel, copper or other suitable metal or plastic materials. A single length of wire can be bent on a wire forming machine to produce the fasteners 14.

The mounting portion 24 can be formed on one end portion of the fastener 14 as a closed loop 30 (FIG. 3) having a positioning and support arm 32 extending transversely across and under the shank 26 (FIG. 2). The "planar" mounting portion 24 defined by loop 30 and arm 32 is fixed against the flat base strip 12, with the arm 32 abutting the lower rib 20. A slight upward bend or hump 34 is formed at the transition between the mounting portion 24 and the shank 26 to accommodate passage of the underlying arm 32 and the lower rib 20 beneath the transition.

The shank 26 extends downwardly from the mounting portion 24 into the anchor portion 28. The anchor portion 28 is formed with one or more lateral projections or wings 36 extending transversely from the shank portion 26. In the example of FIG. 3, the anchor portion 28 is formed generally as a triangular loop extending transversely from the shank 26 in substantially the same plane as the loop 30 of the mounting portion 34. The anchor portion 28 is formed with a first side 40 bent into a second side 42 which is bent into a third side 44 so as to form a generally triangular winged portion extending transversely and laterally with respect to the mounting portion 24.

The third side 44 transitions into a secondary shank portion 45 which transitions into a hook portion 46 having an open mouth 48 (FIG. 3) for receiving the lower edge of a slate tile as discussed further below. Because the secondary shank portion 45 is shorter than the shank portion 26, the secondary shank portion is stiffer and subjected to relatively lower bending moments as compared to fasteners having longer shanks. This provides the hook portion 46 with greater resistance to bending upward from a roof. The mouth portion 48 of the hook 46 extends upwardly, above and substantially perpendicularly to the plane of the three sides 40, 42, 44 of the anchor portion 28. The hook can be located on a second end portion of the fastener 14.

Figure 4:
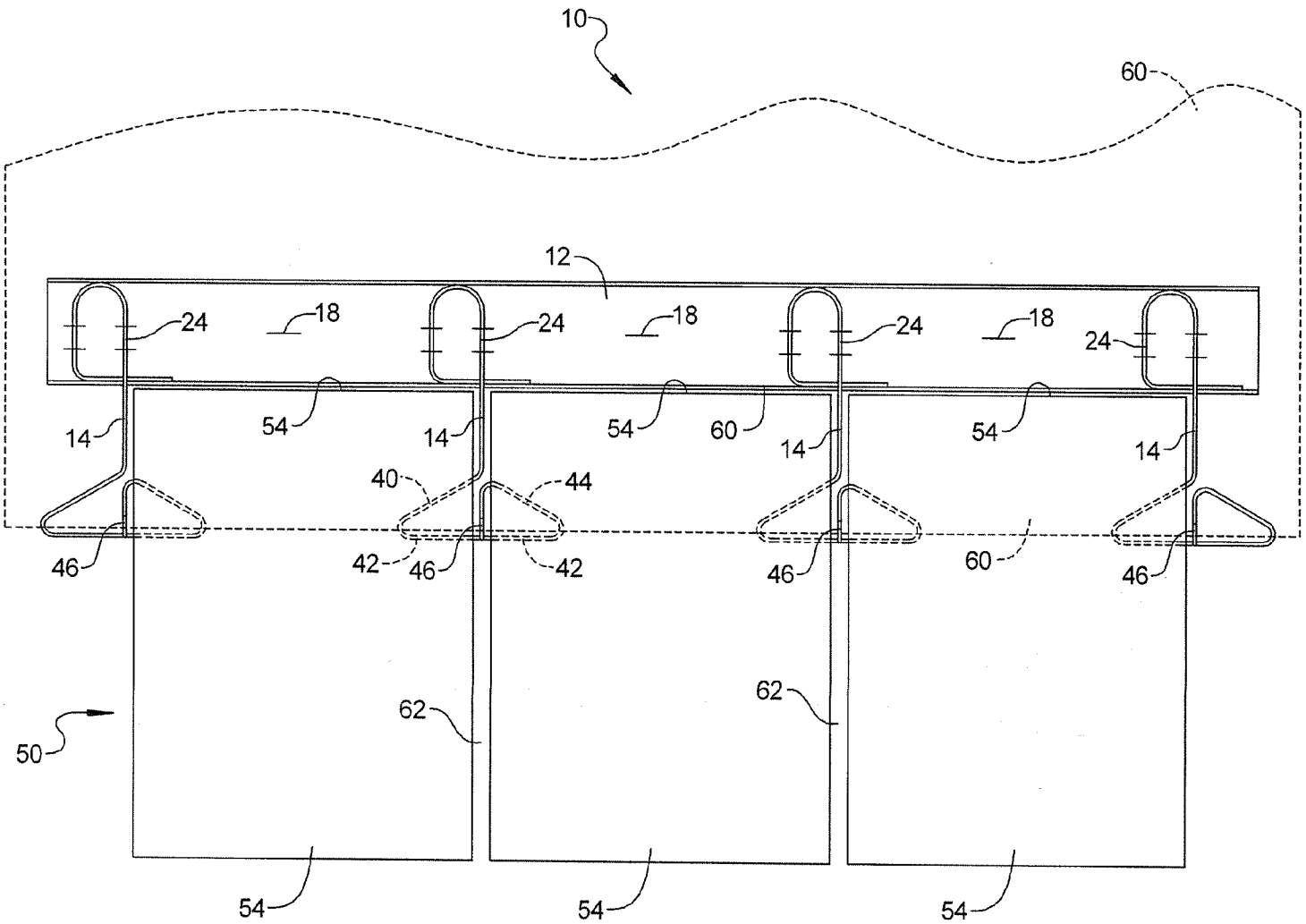
FIG. 4 is a top plan view of a first hook and fastener strip of the type shown in FIG. 1 fastened to a roof with a first row of slate tiles positioned on the roof.

As seen in FIG. 4, a fastening assembly 10 is attached to a roof (not shown) in a conventional manner, such as by staples 18, nails, screws or other fasteners. A first row 50 of slate tiles 54 is positioned on the roof with the upper or top edges 56 of each tile 54 abutting the lower edge 60 of the base strip 12.

The slate tiles 54 fit closely between each adjacent pair of fasteners 14 and lay on top of one half of each anchor portion 28. That is, one side 40 and a portion of the second side 42 of the anchor portion 28 forming a first wing are covered and held down by a first slate tile 54 and the opposite side 44 and a portion of the second side 42 forming a second wing are covered and held down by an adjacent second slate tile 54.

This first row of the tiles 50 can be fixed in position on the roof with nails or other fastening arrangements. However, subsequent rows of tiles do not require any additional fasteners other than the fasteners 14.

Once the first row of tiles 50 is mounted to the roof as described above, a thin sheet 60 of weatherproofing material, such as plastic film, preferably high density polyethylene (HDPE), is fitted into the mouths 48 of each fastener 14. The sheet 60 is shown in dashed lines in FIG. 4. The hooks 46 project through the cracks or slots 62 formed between adjacent slate tiles 54 and project above the top planar surface of the slate tiles to receive the thin sheet 60, as well as the tiles 66 (FIG. 5) in the next row 68 of tiles 66.

Figure 5:
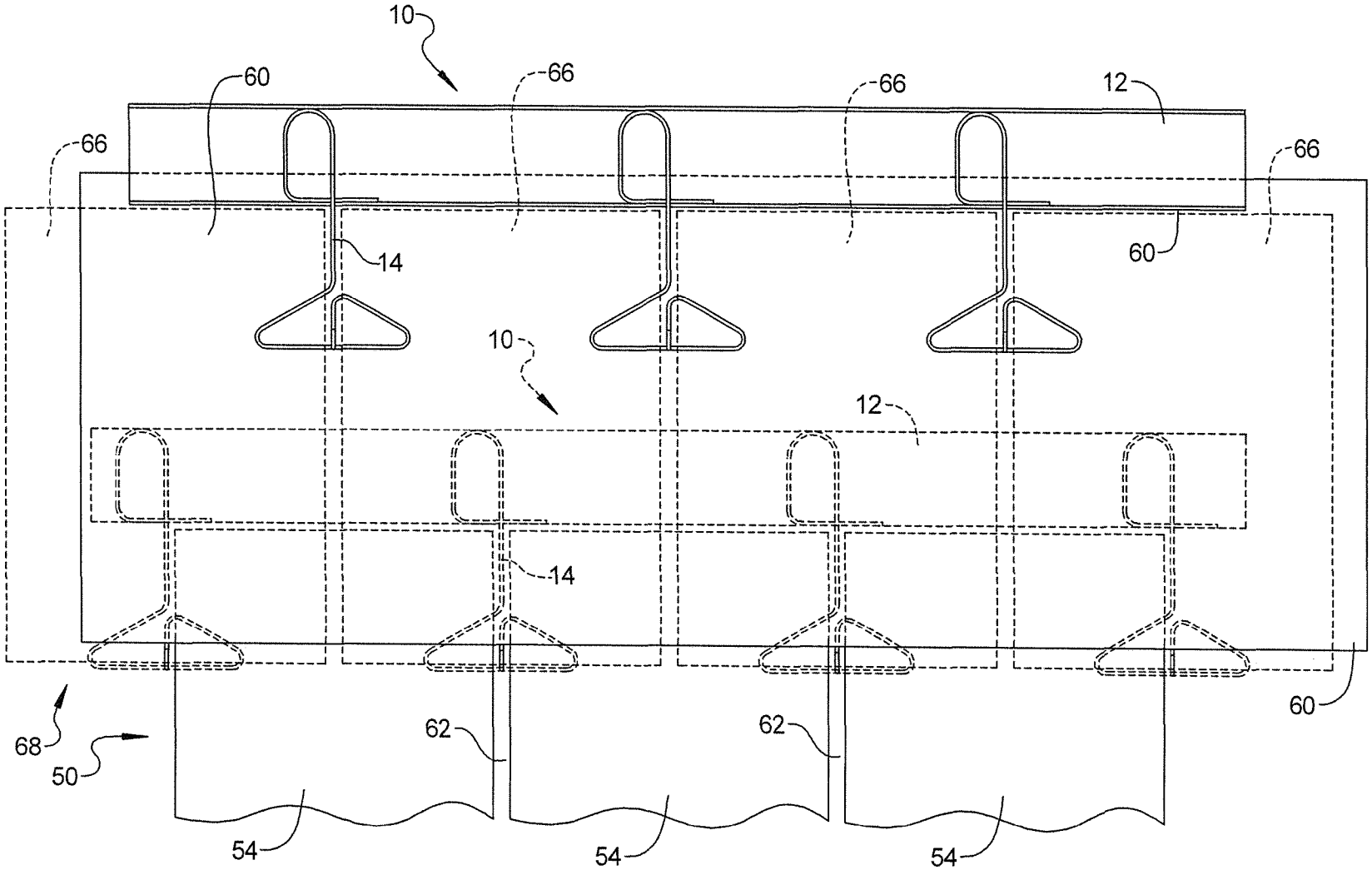
FIG. 5 is top plan view of FIG. 4, with a second hook and fastener strip positioned above the first hook and fastener strip and showing a second row of tile in dashed lines.
Figure 6:
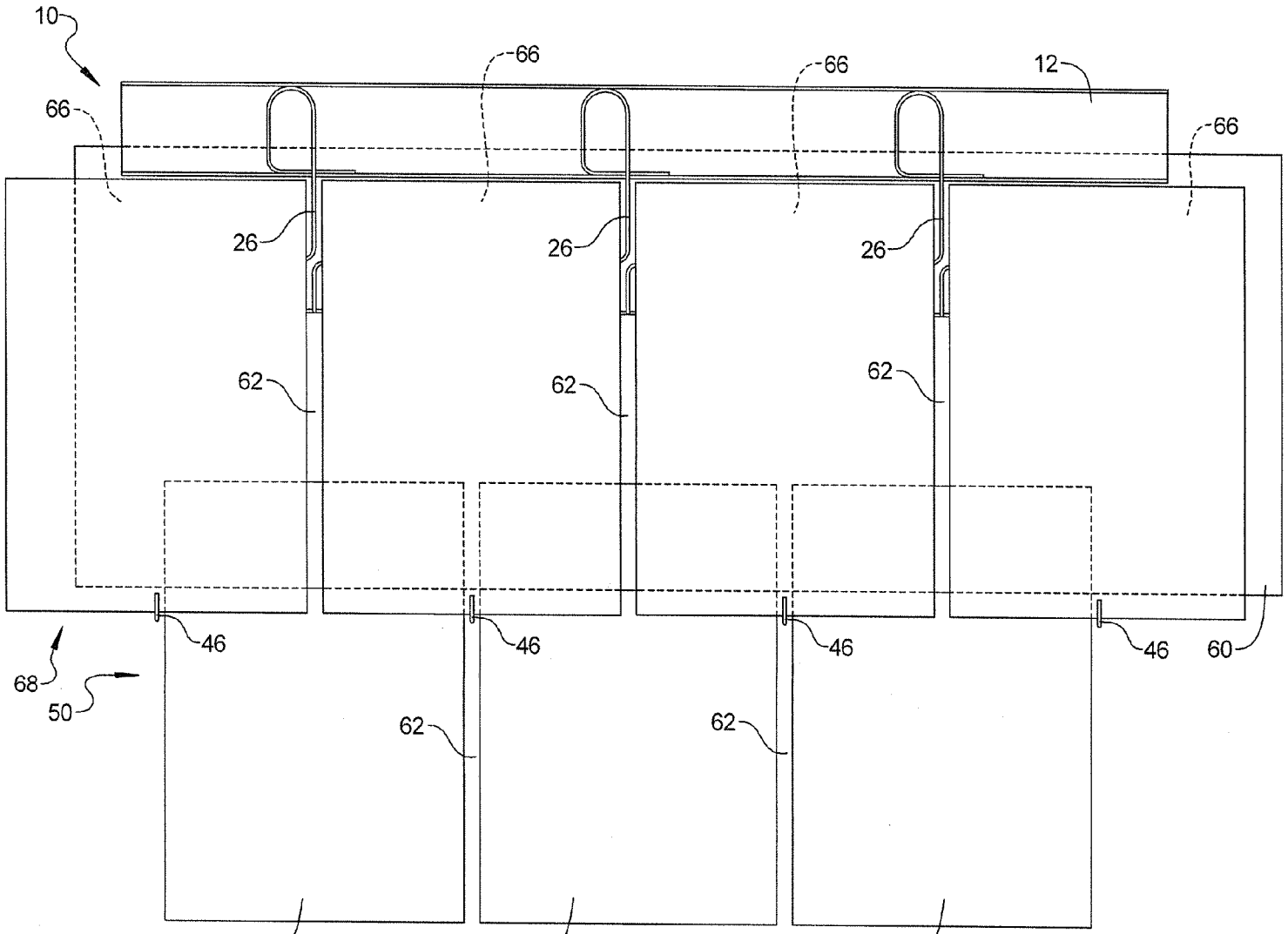
FIG. 6 is a view of FIG. 5 with some dashed lines removed for clarity.

After the weatherproofing sheet 60 is fitted in position as shown in FIG. 4, a second fastening assembly 10 is positioned over the top edge portion of the weatherproofing sheet 60 as shown in FIGS. 5 and 6. This second fastening assembly 10 is aligned with the first fastening assembly 10 so that the shanks 26 of the fasteners 14 on the upper or second fastener assembly 10 are centered over the middle of the slate tiles 54 in the first row 50 of tiles.

At this point, the second row 68 of tiles 66 is installed. This installation is quick and easy. A slate tile 66 is simply inserted into an open mouth 48 of each lower hook 46 as best seen in FIG. 6. (The slate tiles 66 are shown in dashed lines in FIG. 5 to allow the weatherproofing sheet 60 drawn in solid lines to be seen more clearly.) Once the second row 68 of tiles 66 is installed, another or second weatherproofing sheet 60 (not shown) is inserted into the mouths 48 of the fasteners 14 on the second or upper fastener assembly 10 in the same manner as discussed above.

A third fastener assembly 10 is then positioned over the top of the second weatherproofing sheet 60 and a third row of tiles (not shown) is aligned over the first row 50 and centered offset from the second row 68 and inserted into the mouths 48 of the fasteners 14 as described above. This process can be repeated until the roof is substantially covered with slate tile.

Figure 7:
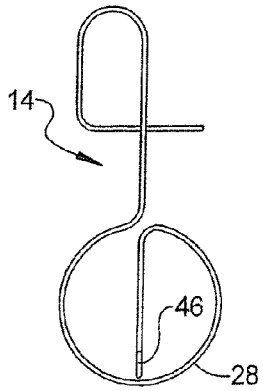
FIG. 7 through FIG. 12 are top plan views of alternate hook designs.
Figure 8:
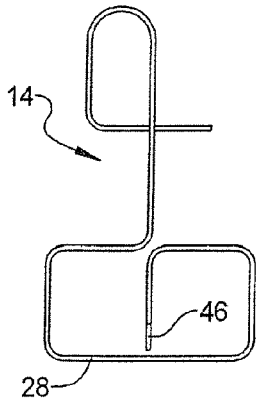
Figure 9:
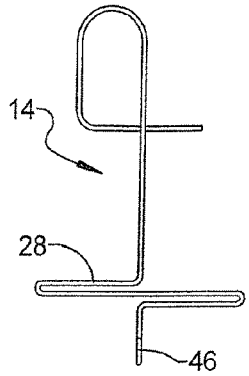
Figure 10:
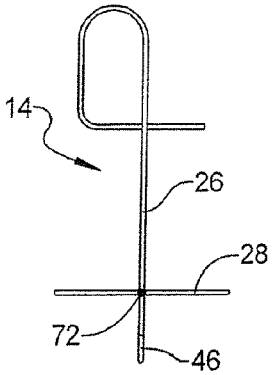
Figure 11:
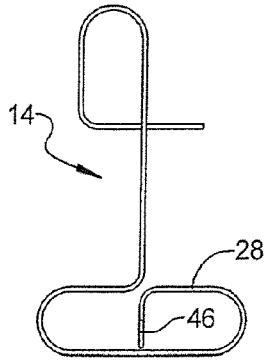
Figure 12:
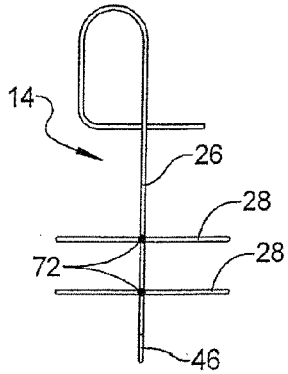

FIGS. 7 through 12 show other possible configurations of fastener 14 formed with different anchor portions 28. A single wire can be bent or formed into the fasteners 14 of FIGS. 7, 8, 9 and 11. The fasteners 14 of FIGS. 10 and 12 can fabricated with separate wire anchor portions 28, such as by weld joints 72. Separate planar anchor portions 28 can also be formed of sheet metal or plastic. In FIG. 7, the anchor portion 28 is formed substantially in a circular form, and in FIG. 8 as a substantially rectangular form. In FIG. 9, the anchor portion 28 is formed as a vertically compressed letter "S" or tight serpentine zig zag form. FIG. 10 illustrates a cruciform or linear anchor portion 28 while FIG. 11 illustrates an oval or "racetrack" form of anchor portion 28. FIG. 12 depicts an anchor portion 28 having a double cruciform shape with two separate linear anchor portions 28. A triangular anchor portion 28 is shown in FIG. 13, but this embodiment can be constructed with any of the anchor portions disclosed herein, as well as any functional equivalents.

Figure 13:
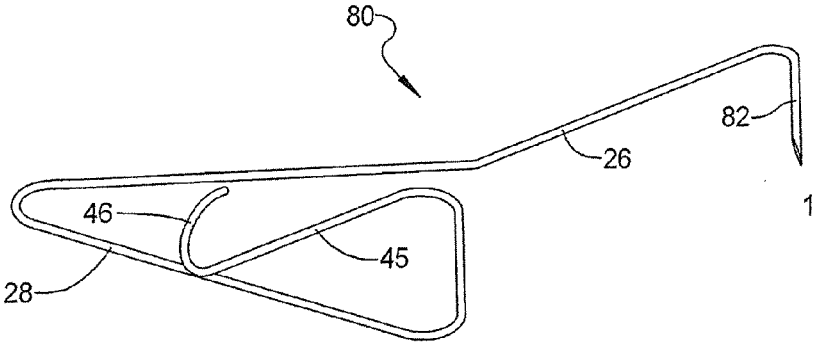
FIG. 13 is a perspective view of a fastener configured for nailing directly to a roof without a strip.

As seen in FIG. 13, a separate wire fastener 80 includes a mounting portion having a downwardly extending nail portion 82 that can be nailed directly into a roof without the need for a base strip 12. The fastener 80 is used and positioned as described above with respect to the fasteners 14 on base strip 12. Fasteners 80 can also be driven through holes in slate tiles as commonly practiced on conventional roofing installations.

Figure 14:
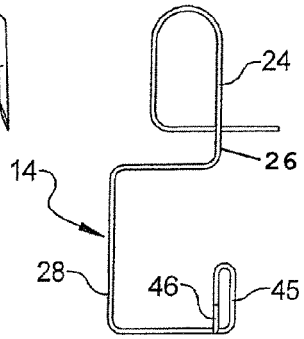
FIG. 14 is an alternate embodiment of a fastener with a short primary shank portion and which is formed with a single lateral anchor projection.

It will be appreciated by those skilled in the art that the above wind resistant tile roofing system is merely representative of the many possible embodiments of the disclosure and that the scope of the disclosure should not be limited thereto. For example, as shown in FIG. 14, the shank portion 26 may be eliminated or shortened so that the mounting portion 24 transitions directly into the anchor portion 28. This embodiment includes an anchor portion 28 formed with a single lateral projection or wing 36 constructed to underlie a single tile. It can be readily appreciated that the fasteners 14 of FIGS. 3 and 7-13 can also be formed with single lateral projections.

What is claimed:

1. A fastener for holding tiles on a roof, comprising:

a mounting portion on a first upper end portion of said fastener for holding said fastener on a roof;

a first shank portion extending downwardly from said mounting portion;

a secondary shank portion extending downwardly below said first shank portion;

an anchor portion constructed to receive weight from overlying tiles, said anchor portion extending transversely from a bottom portion of said first shank portion and having a first anchor portion extending transversely in a first direction below said mounting portion and configured to extend transversely under at least one first roofing tile and having a second anchor portion extending transversely in a second direction opposite said first direction below said mounting portion and configured to extend transversely under at least one second roofing tile, said first anchor portion extending transversely into said second anchor portion; and a hook portion on a second end portion of said fastener, said hook portion extending outwardly above said anchor portion and above said secondary shank portion and having a mouth configured to project upwardly between adjacent tiles to receive and hold an edge portion of a roofing tile.

2. The fastener of claim 1, wherein said mounting portion comprises a closed loop.

3. The fastener of claim 1, wherein said hook portion consists of a single hook.

4. The fastener of claim 1, wherein said secondary shank portion is shorter than said first shank portion.

5. The fastener of claim 1, further comprising a support arm extending transversely across a top portion of said first shank portion.

6. The fastener of claim 1, wherein said first shank portion extends downwardly between said mounting portion and said anchor portion.

7. The fastener of claim 1, wherein said mounting portion and said anchor portion extend in a common plane.

8. The fastener of claim 7, wherein said hook portion extends in a plane substantially perpendicular to said common plane.

9. The fastener of claim 1, further comprising a transition portion comprising an upward bend separating said mounting portion from said first shank portion.

10. A fastener assembly for holding roofing tiles on a roof, comprising:

a base strip; and at least one fastener held on said base strip, said fastener comprising a mounting portion permanently engaged on said base strip, an anchor portion comprising at least one lateral projection configured to extend beneath at least one roofing tile and a hook portion extending upwardly away from said anchor portion for receiving and holding an edge portion of a roofing tile and wherein said base strip comprises at least one upstanding rib extending laterally along an edge of said base strip and engaged with said mounting portion of said fastener to position and hold said fastener in place on said base strip.

11. The fastener assembly of claim 10, wherein said base strip comprises a flexible plastic strip and wherein said mounting portion of said fastener is fixed to said base strip with a fastener.

12. The fastener assembly of claim 10 wherein said fastener comprises a wire foil ling said mounting portion and said anchor portion.

13. The fastener assembly of claim 10, wherein said anchor portion comprises a form selected from the group consisting of a triangle, a circle, a rectangle, a zig zig, a cross, a plurality of crosses and an oval.

14. A slate tile roof assembly, comprising:

a plurality of fasteners spaced apart along a roof, said plurality of fasteners each comprising an anchor portion, a hook portion, a first upper shank portion and a secondary lower shank portion, said anchor portion extending laterally from a bottom portion of said first shank portion above said secondary shank portion;

a plurality of slate tiles aligned in a row along said roof and wherein said anchor portions are each located beneath an adjacent pair of said tiles and held on said roof at least partially by the weight of said adjacent pair of tiles; and wherein said hook portion projects upwardly between said adjacent pair of tiles and receives a lower edge portion of a third tile, and wherein said secondary shank portion extends into said hook portion.

15. The slate tile roof assembly of claim 14, wherein said anchor portion resists upward movement of said hook portion.

16. The slate tile roof assembly of claim 14, further comprising a base strip fastened to said roof, and wherein said plurality of fasteners is carried on said base strip.

17. The slate tile roof assembly of claim 14, further comprising a weatherproofing sheet overlying an upper portion of said plurality of tiles.

18. The slate tile roof assembly of claim 14, wherein said anchor portion comprises first and second anchor portions and wherein said first anchor portion is located under a first slate tile and said second anchor portion is located under a second slate tile.

* * * * *